US005908240A

United States Patent [19]

Hood

[11] Patent Number: 5,908,240

[45] Date of Patent: Jun. 1, 1999

[54] APPARATUS FOR CEMENT BLENDING CAPABLE OF FORMING A THICK SLURRY

[76] Inventor: Max George Hood, 17 Serpentine Road, Erina Heights, New South Wales 2260, Australia

[21] Appl. No.: 08/765,857

[22] PCT Filed: Jun. 28, 1995

[86] PCT No.: PCT/AU95/00383

§ 371 Date: Mar. 17, 1997

§ 102(e) Date: Mar. 17, 1997

[87] PCT Pub. No.: WO96/00640

PCT Pub. Date: Jan. 11, 1996

[30] Foreign Application Priority Data

Jun. 30, 1994 [AU] Australia ..... PM6578

[51] Int. Cl.[6] ..... B28C 5/16; B01F 11/00

[52] U.S. Cl. ..... 366/18; 366/43; 366/65; 366/67; 366/114; 366/138; 366/191

[58] Field of Search ..... 366/18, 29, 34, 366/35, 37, 43, 64–67, 114, 141, 182.4, 191, 262, 263, 264, 265, 270, 312, 138, 118

[56] References Cited

U.S. PATENT DOCUMENTS

| | | | |
|---|---|---|---|
| 2,298,317 | 10/1942 | Smith . | |
| 2,367,149 | 1/1945 | Smith . | |
| 3,480,261 | 11/1969 | Eirich et al. . | |
| 3,601,369 | 8/1971 | Wahl | 366/114 |
| 3,967,815 | 7/1976 | Backus et al. | 366/64 |
| 4,277,180 | 7/1981 | Munderich | 366/7 |
| 4,298,288 | 11/1981 | Weisbrod | 366/35 |
| 4,335,964 | 6/1982 | Drake et al. | 366/114 |
| 4,506,982 | 3/1985 | Smithers et al. | 366/35 |
| 4,588,299 | 5/1986 | Brown et al. | 366/18 |
| 4,792,234 | 12/1988 | Doherty | 366/18 |
| 4,830,505 | 5/1989 | Dunton et al. | 366/34 |
| 4,854,715 | 8/1989 | Eirich et al. | 366/139 |
| 4,895,450 | 1/1990 | Holik | 366/141 |
| 4,963,031 | 10/1990 | Brown | 366/18 |
| 5,249,861 | 10/1993 | Thomson | 366/312 |
| 5,718,510 | 2/1998 | Farmery et al. | 366/266 |
| 5,813,754 | 9/1998 | Williams | 366/114 |

FOREIGN PATENT DOCUMENTS

| | | | |
|---|---|---|---|
| 454106 | 10/1991 | European Pat. Off. | 366/118 |
| 2399273 | 4/1979 | France | 366/114 |
| 2544597 | 4/1977 | Germany | 366/114 |
| 3618735 | 12/1987 | Germany . | |
| 3836930 | 5/1990 | Germany . | |
| 289932 | 2/1971 | U.S.S.R. | 366/114 |
| 881741 | 11/1961 | United Kingdom | 366/114 |
| 1399035 | 6/1975 | United Kingdom . | |
| 1473974 | 5/1977 | United Kingdom . | |
| 1532932 | 11/1978 | United Kingdom . | |

*Primary Examiner*—Charles E. Cooley
*Attorney, Agent, or Firm*—Leydig, Voit & Mayer, Ltd.

[57] ABSTRACT

An apparatus for cement blending includes a pressure vessel for containing a slurry and an agitating member which mixes the slurry within the pressure vessel. The pressure vessel includes a first inlet for connection to a source of pressurized driving fluid and a first outlet through which the slurry can be discharged when the pressure vessel is pressurized by the driving fluid. The apparatus is capable of blending a thick slurry of water and cement. A vibrating mechanism vibrates the vessel to facilitate mixing of the slurry and discharge of the slurry from the vessel by the driving fluid.

23 Claims, 4 Drawing Sheets

APPARATUS FOR CEMENT BLENDING CAPABLE OF FORMING A THICK SLURRY

TECHNICAL FIELD

The present invention relates to cement blenders and more particularly to a blender for mixing and discharging a slurry of primarily dry cement particulates and water.

BACKGROUND ART

In conventional concrete mixing, aggregates such as sand and stone are added together with cement powder and water, and then mixed to form concrete. Generally, the ingredients are mixed either in a central plant mixer or in a rotating truck mounted bowl mixer.

It has been found, however, that mixing times are reduced by up to 30% if a slurry of dry cement and water is mixed before the aggregate is added. In addition to the shorter mixing times, this method results in a more homogeneous mixture. Moreover, because the aggregate achieves a more uniform coating of cement slurry a higher strength concrete is produced compared to that produced by the conventional dry batch mixing method.

For these reasons, cement blenders have been developed for the purpose of initially mixing the dry cement powder with water to produce a cement slurry, which is subsequently discharged into a central or truck mixer for the addition of aggregrate.

Known cement blenders typically comprise a mixing chamber containing a mechanism for stirring the slurry, and a pump drawing from the bottom of the chamber to pump the slurry back into the top of the chamber until thoroughly mixed after which the same pump is used to deliver the slurry to the concrete mixer. However, blenders of this type are limited to mixing slurries of a cement to water ratio of less than about 2:1. If a higher ratio is attempted, for example 3:1, the slurry becomes too thick to interact with the stirring mechanism, which then rotates in a dead space within the thick slurry mixture. The slurry also sticks to the walls of the chamber and so cannot migrate to the outlet. This in turn causes the pump to cavitate, resulting firstly in possible wear and damage to the mixer, and secondly in the bulk of the slurry remaining in the mixing chamber unable to be mixed or discharged.

This problem can increase if other fillers are added to the cement particulate which is common practice. For example, silica fume is used to increase the strength of the final concrete mix and fly-ash is used as a cheaper substitute for cement particulate. It is quite common to have 80% cement particulate and 10% by weight each of silica fume and fly-ash. Because these fillers have a lower specific gravity than cement, their presence further increases the particulate to water ratio of the slurry.

Tests have shown that only about half of the water added is needed directly for hydration of the cement, whilst the remainder is required for reducing viscosity to facilitate pumping and to increase the workability of the final concrete. Unfortunately however, any increase in water content of the slurry or the concrete beyond the minimum requirement for hydration is inversely proportional to the strength of the concrete finally produced. Consequently, known cement blenders, being unable to mix and pump slurries having a cement to water ratio of more than around 2:1, are unable to produce concrete having optimum strength characteristics.

SUMMARY OF THE INVENTION

It is an object of the present invention to overcome or substantially ameliorate at least some of the deficiencies of the prior art.

According to a first aspect of the present invention, there is provided an apparatus for mixing and discharging a slurry consisting primarily of water and cement, said apparatus comprising:

a pressure vessel adapted to container slurry; and an agitating mechanism disposed to mix the slurry within the pressure vessel;

said pressure vessel including a first inlet adapted for connection to a source of pressurised driving fluid, and a first outlet for discharge of said slurry upon pressurisation of the vessel by the driving fluid; and wherein the agitating mechanism includes an impeller disposed within the vessel, such that rotation of the impeller causes the slurry to flow downwardly from the impeller hence to be re-directed outwardly and upwardly in a circulatory mixing action.

Preferably, the vessel has vertical main side walls and a lower conical section tapering inwardly to the first outlet disposed in the bottom of said vessel.

Desirably, the impeller includes a vertical drive shaft disposed centrally within the vessel and at least one mixing element. The drive shaft is driven by an externally mounted motor and gear box.

In one embodiment, the shaft also includes scraping means adapted to remove cement slurry from the inside surface of the vessel. Preferably, the scraping means includes one or more scraper arms positioned to scrape the inner surface of the vessel near the top of the slurry volume.

The vessel preferably further comprises a vibration mechanism to facilitate mixing and discharging the slurry.

Preferably also, the vessel is suspended on hanging load cells so the vibration is not transmitted to other areas of the plant. This allows vibration of increased amplitude and frequency to be applied to the vessel and its contents, compared to the amplitude and frequency able to be applied to a solid mounted vessel.

In a further embodiment, the vessel comprises second and third inlets, respectively adapted for water and cement introduction, each inlet having a selectively operable control valve.

In another preferred embodiment, the vessel may also comprise a second outlet adapted to release air displaced as the pressure vessel is filled with water and cement. Desirably, the second outlet includes a filter. In this embodiment, both the first and second outlets also include selectively operable control valves.

BRIEF DESCRIPTION OF THE DRAWINGS

A preferred embodiment of the invention will now be described, by way of example only, with reference to the accompanying drawings in which.

DESCRIPTION OF THE PREFERRED EMBODIMENTS

Figure 1:
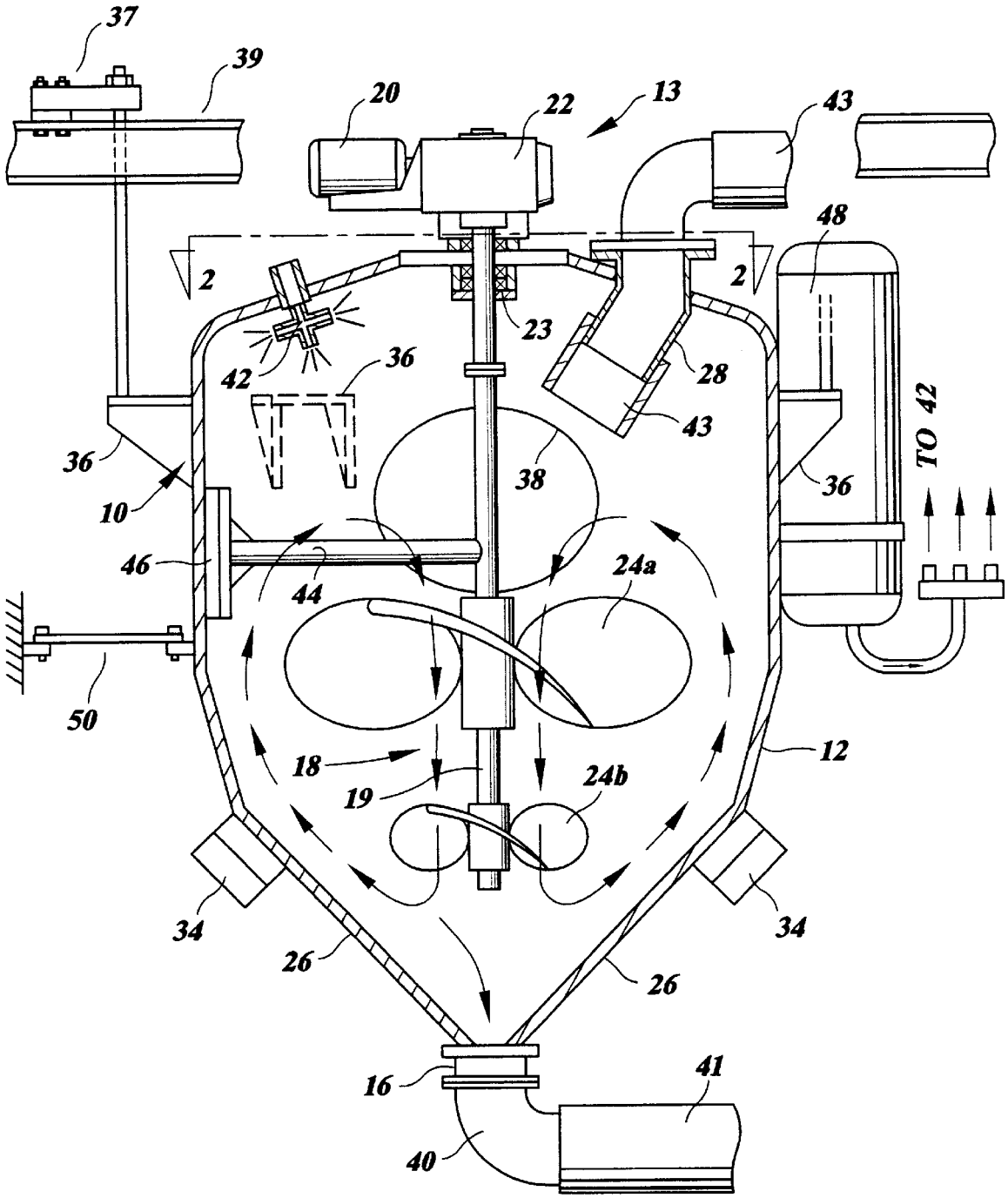
FIG. 1 is a sectional side elevation of a cement mixing apparatus according to the invention.

Referring to the drawings, the invention provides an apparatus 10 for mixing and discharging a slurry consisting primarily of water and cement. The apparatus includes a pressure vessel 12 adapted to contain the slurry an agitating mechanism indicated generally at 13.

The pressure vessel includes a first inlet 14 adapted for connection to a source 80 of pressurised driving fluid, and an outlet 16 for discharging the slurry upon pressurisation of the vessel.

The agitating mechanism 13 includes an impeller 18 supported within the vessel by means of drive shaft 19 which is rotated via motor 20 via and gear box 22 located outside the vessel. The shaft 19 enters the top of the vessel through a stuffing box 23 to retain the air pressure within the vessel and to prevent slurry from entering the gearbox 22. The impeller 18 further includes upper and lower mixing elements 24*a* and 24*b* respectively each of which incorporates a series of inclined mixing blades. In a particularly preferred embodiment, the mixing elements are commercially available units identified as LIGHTNIN® model A320. Generally, diameter of the upper element 24*a* is approximately half that of the vessel whilst the lower 24*b* is approximately one quarter.

The illustrated embodiment enables small batches of cement slurry to be produced by mixing element 24*b* and larger batches to be mixed by both 24*a* and 24*b*. In an alternative embodiment, however, it is possible to use only one mixing element, if the batch size is consistent.

Rotation of the impeller drive shaft 13 and the associated mixing blades causes the slurry to flow downwardly from the impeller 18, then to be directed by the side walls of the vessel 13 outwardly and upwardly around the impeller 18, then inwardly and again downwardly in a circular mixing action. This action is generally indicated by arrows in FIG. 1. The redirection of the slurry flow is aided by the vessel 12 having vertical side walls and a lower section 26 tapering inwardly toward the outlet 16.

Figure 2:
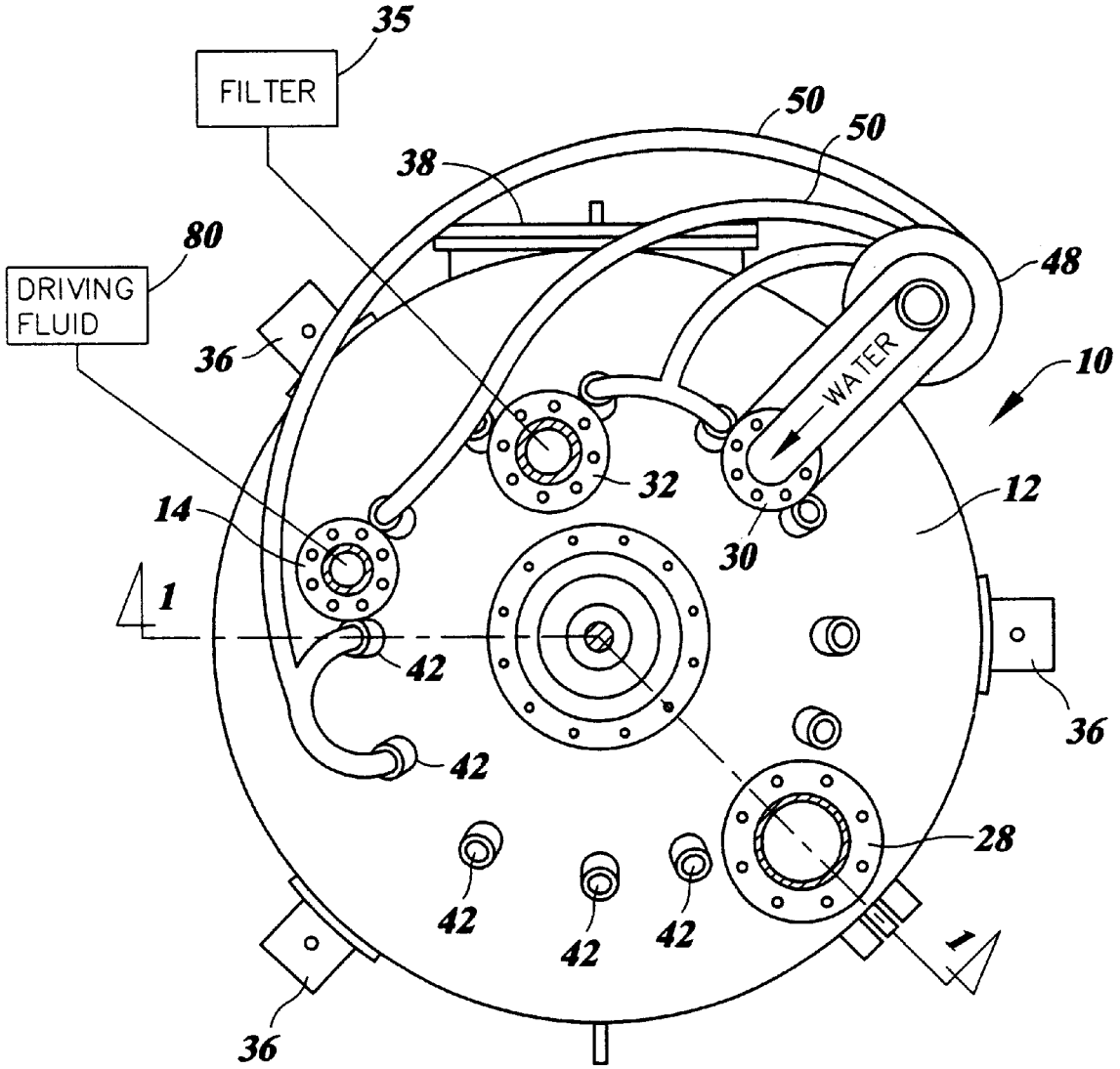
FIG. 2 is a plan view of the apparatus shown in FIG. 1.
Figure 3:
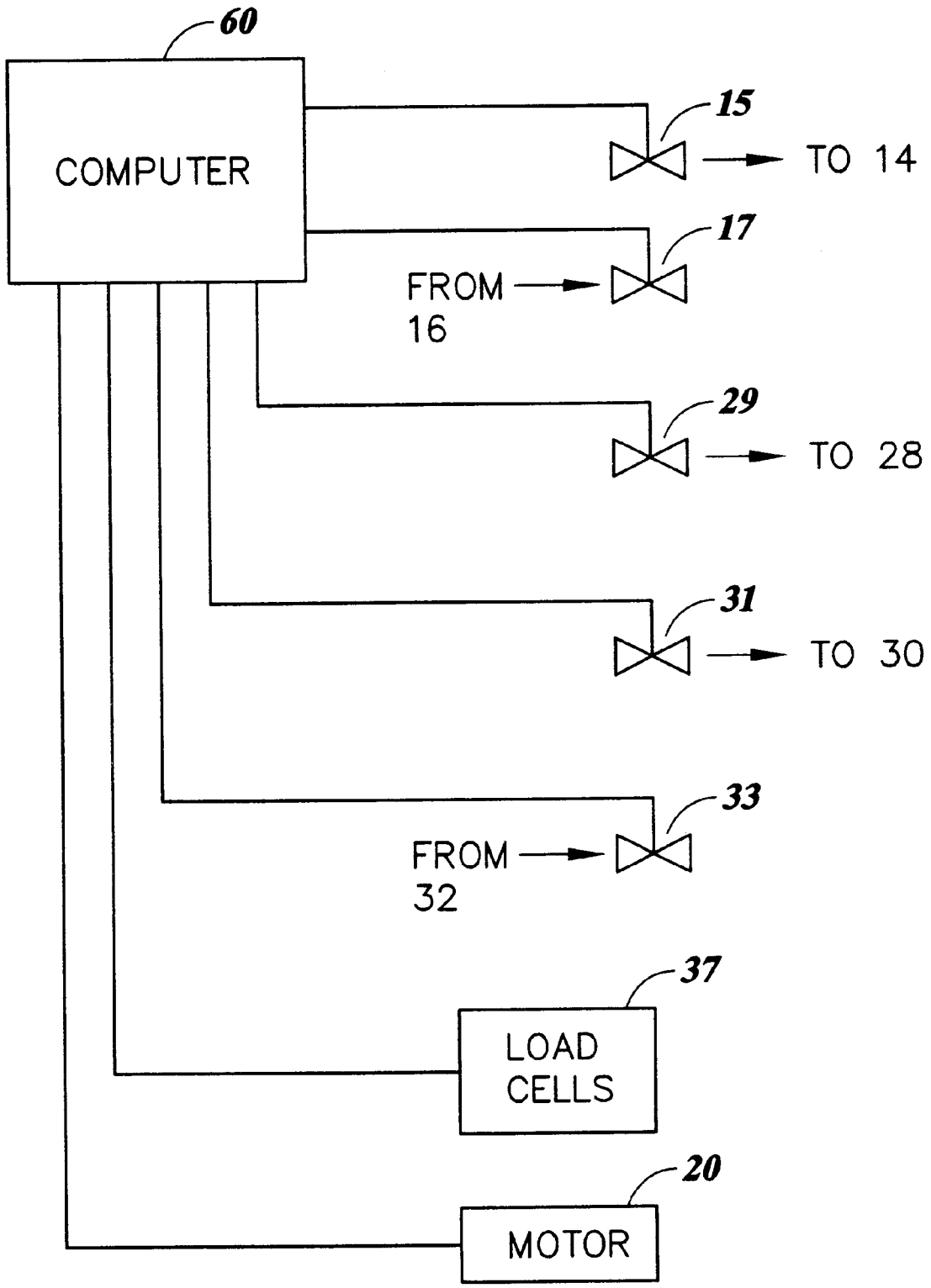
FIG. 3 is a block diagram of a control system for the mixing apparatus of FIG. 1.

As shown in FIG. 2, the vessel also includes a cement particulate inlet 28, a water inlet 30 and an air breather outlet 32. As shown in FIG. 3, the inlets 14, 28, 30 and outlets 16 and 32 are selectively opened and closed by electrically controlled butterfly valves 15, 29, 31, 17, and 33, respectively, the positions of which are dependent on the particular charging, mixing or discharging stage the mixing apparatus is undergoing. A filter 35 may be connected to the breather outlet 32 to trap any cement dust exiting through the breather outlet 32 as the vessel 12 is charged with dry cement. An example of a suitable filter 35 is a canvas bag supported vertically above the valve 33 for the breather outlet 32.

Vibration mechanisms 34 are attached to the outside of the vessel 12 to aid in slurry mixing and discharge. The vibration mechanisms 34 may have any desired structure. For example, they may comprise an eccentric mass rotatably driven by an electric motor to impart vibration to the vessel 12. Alternatively, they may be pneumatic, hydraulic, mechanical, ultrasonic, or other type of vibrator. To ensure the vibration does not damage associated plant and equipment, the vessel is suspended at brackets 36 by hanging load cells 37 mounted on a support frame 39, for example, at a plurality of locations around the vessel 12 and connected to the brackets 36 by rods. The load cells 37 also enable the slurry production to be electrically weighed and monitored to provide an indication of when the vessel is full or empty. Torque rods 50 may be used to ensure the vessel does not rotate about its axis in response to acceleration of the impeller and the associated drive mechanism.

The vessel further includes a man-hole 38 to allow access to the vessel interior, and a slurry outlet pipe 40 leading to, for example, a concrete truck or central plant mixer. The slurry outlet 40 is connected to the truck or mixer by a rubber pipe 41. This permits the vessel to remain effectively suspended without any external mechanical connections which could adversely affect the accuracy of the weighing. For similar reasons, all the inlets to the mixer are connected by flexible tubing or couplings.

The vessel top also has a plurality of water inlet jets 42. These jets 42 enable cleansing water to be sprayed into the vessel 12 in several directions to clean any remaining cement slurry from the side walls between and/or during batches. Also, the rotating impeller shaft 19 support a scraper arm 44 supporting a scraper blade 46 which wipes the interior of the vessel at or above the slurry level. In another embodiment (not shown), an alternative arrangement for cleaning the vessel interior consists in a ring of spray jets attached to the impeller shaft 19 and fed by an external water source attached to the shaft by a water-tight gland. This enables the jets to rotate with the shaft while spraying water to cleanse the vessel interior. In both cases, water pressure is higher than the pressure of the driving fluid.

All aspects of the apparatus including valves, vibrating mechanisms 36, spray jets 42 and motors are controlled by a computer 60. The size and formulation of the desired slurry batch can thus be selected by a remote operator. The computer 60 then controls the valves, motor and vibrators accordingly to produce the desired batch.

The use of the apparatus in production of a batch of cement slurry will now be described in more detail. When the computer 60 first signals that a batch is to be produced, all inlets and outlets including in particular cement inlet 28, driving fluid inlet 14, and outlet 16 are closed. The impeller motor 20 is then started, air breather outlet 32 is opened and water is introduced into the vessel through inlet 30. Outlet 32 releases air displaced by the introduction of the water and later by the cement. Water is also added through spray jets 42 at this stage to aid in cleaning the inner surface of vessel. When the load cells 37 indicate that two thirds of the total water to be used has been supplied to the vessel 12, cement particulate inlet 28 is opened and the calculated amount of cement, or a desired mixture of cement and fly-ash and silica fume for example, is added. The vibrators 34 begin operation when, or soon after, this cement addition begins.

Cement inlet 28 is connected to rubber or linatex socks 43 above and below inlet 28 to ensure cement does not clog the inlet or interfere with the load cells 37 as previously described. When the load cells 37 indicate the correct amount of cement particulate has been added, the cement inlet 28 is closed. Cement particulate is generally stored in an overhead weighing hopper which can be used to provide a double check on the amount of cement particulate added to the vessel for quality control purposes, if required. Water inlet 30 also closes when the required amount of water has been admitted to the vessel. Air breather outlet 32 is closed when the required amounts of both cement and water have been added.

The impeller is already rotating and the cement particulate and water begin mixing to form the slurry. After a predetermined mixing time a pressurised driving fluid, usually air, is used to pressurise the vessel. When the mixing cycle is complete and the vessel pressurised to between two and five bar the outlet 16 is opened. The air pressure within the vessel, assisted by the vibration, is thus used to force the slurry through discharge outlet 16 and pipe 40 to either a truck or central mixer.

In some applications it has been found that either pressurising the vessel or energising the vibrators, or both, during the mixing cycle and prior to opening the outlet 16 can increase the speed and efficiency of the mixing and discharging.

An air pressure gauge (not shown) indicates the air pressure inside the vessel throughout the procedure. When the gauge indicates a predetermined drop in pressure, the computer is notified by a central signal that the vessel has been emptied. The empty condition of the vessel is also verified by signals from the load cells of a predetermined weight change threshold. The outlet 16 is then closed and the vessel is configured for a new batch.

As shown in the drawings there is a rinse tank 48 of approximately 60 liter capacity mounted adjacent the vessel 12. Water from an overhead hopper flows under gravity into the rinse tank 48 then overflows into the water inlet jets 42 through hoses 50 or other conduits for rinsing.

Approximately half of the rinse tank volume is sprayed into the vessel interior, via jets 42, immediately after the cement powder has been fully introduced into the blender. This serves to rinse down any dry powder clinging to the inner walls of the blender which are often wet. A second rinse occurs when about 90% of the mixed slurry has been pumped out of the blender. Again the jets 42 spray the water onto the interior walls of the blender to remove residual slurry. The rinse water mixes with the residual slurry and by doing so reduces its viscosity slightly. This serves to aid in pumping the residual slurry out of the blender into the awaiting mixer and also to rinse the outlet 40 and delivery pipe 41.

The volume of rinsing water used in each stage is adjustable by a timer incorporated into the control system. If the outlet pipe is of a relatively long length or involves through a significant height differential, the same or another source of pressurised driving fluid can be connected to the outlet pipe 40 adjacent slurry outlet 16. The driving fluid is thereby operative when valve 16 is closed, to purge any remaining slurry and/or rinse water out of the discharge pipe and into the concrete mixing point. This saves wastage of cement, clogging of equipment and enables the blender to be recharged whilst pipe 41 is being purged and/or rinsed.

Figure 4:
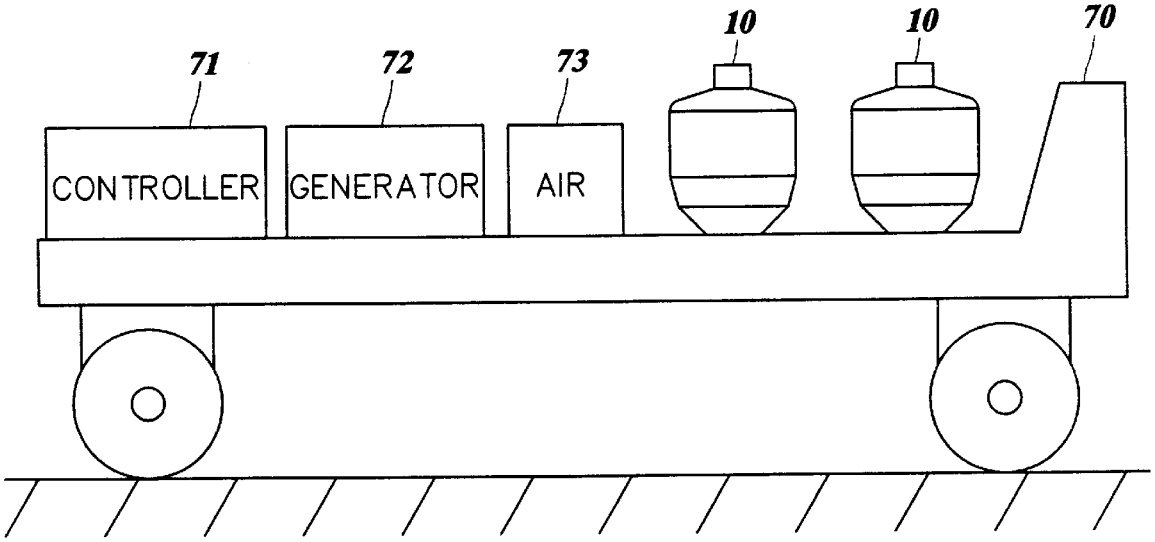
FIG. 4 is a schematic elevation of an embodiment including a plurality of mixing apparatuses mounted on a mobile trailer.

In another embodiment of the invention shown in FIG. 4 one or more blenders 10 are mounted on a road trailer 70 for use in road stabilization.

This allows the cement slurry to be mixed and discharged directly onto the road surface being stabilized. The slurry, water and about a 200 m depth of the road surface are then mixed to form a stable cement layer over the existing gravel or clay road surface.

Generally, two blenders 10 are mounted to the trailer 70 and are configured to sequentially mix and discharge their respective slurry contents to, in effect, provide a continuous slurry output.

The blender control system 71 and power source, such as a diesel generator 72 and air compressor 73, are all mounted on the trailer 70 as are the necessary raw material storage hoppers.

This system obviates the need to initially lay powdered cement and subsequently add water, as is currently the practice, and thereby overcomes the problem of pollution generated by air-borne dust.

When attempting to produce high strength concrete using previously known cement blenders, the higher cement to water ratios involved required the addition of dry cement particulates, which were unable to be added to the slurry in the blender, during the mixing of the final concrete. This result in health hazards to operators due to the airborne dust generated by the dry cement and any other fillers such as flyash or silica fume. In order to overcome this problem, expensive dust extraction equipment is required at the addition point.

By contrast, the present invention is capable of mixing a cement slurry having a cement to water ratio of 3:1 by weight and higher. This results in stronger concrete, significant cost savings to concrete producers and reduced health risks to workers and operators.

Also, the aggregate finally mixed with the slurry often contains additional moisture. For this reason, the aggregate is normally weighed before mixing and the calculated amount of additional moisture present is subtracted from the water added initially to the slurry, to ensure that the desired proportions of the final concrete mix are achieved. However, this often results in the initial slurry having a higher than nominal cement to water ratio, which conventional blenders cannot mix. Since the apparatus according to the invention can mix higher cement to water ratios, this problem arising from wet aggregate is reduced or eliminated.

Furthermore, known concrete production plants have relied primarily on gravity to feed the necessary ingredients to weigh hoppers and mixers. Conventional blenders as previously described have in the past been limited to discharging the cement slurry by gravity to a point below the mixing vessel's outlet. This has meant that existing blenders have been located at elevated or otherwise inconvenient points in the plant. Thus, for example, if the outlet of a blender was positioned to feed into a truck mixer by gravity, its outlet would have to be above the height of the truck mixer inlet, resulting in either repositioning of the raw material silos and other mixers, or using extra handling devices, such as elevators, or conveyors to feed raw material to the blender.

In the case of the present invention, however, the slurry is forced through the outlet tube from the vessel by a pressurised driving fluid which enables the vessel to be more easily located in an existing plant. Thus, a further advantage is that the vessel can be located at an accessible location whether above or below its own delivery point, such as at ground level or a level otherwise convenient to the existing plant architecture and only a single pipe need lead to either a central mixer or bowl truck inlet. This in turn leads to significant additional cost savings throughout the whole plant.

Thus, the ability to mix cement slurries of higher cement to water ratios than previous mixers coupled with the significant cost savings in installing the mixer in existing plants renders the invention a significant improvement over the prior art.

Although the invention has been described with reference to specific examples, it will be appreciated by those skilled in the art that the invention may be embodied in many other forms.

What is claimed is:

1. An apparatus for mixing and discharging a slurry of water and cement comprising:

a pressure vessel adapted to contain slurry and including a first inlet connected to a source of pressurized driving fluid and a first outlet for discharge of the slurry upon pressurization of the vessel by the driving fluid;

an agitating mechanism disposed to mix the slurry within the pressurized vessel and including an impeller disposed within the vessel such that rotation of the impeller causes the slurry initially to flow downwardly from the impeller to be redirected outwardly and upwardly in a circulatory mixing action; and a vibrating mechanism for vibrating the vessel to facilitate mixing of the slurry and discharge of the slurry from the vessel by the driving fluid.

2. An apparatus as claimed in claim 1 wherein the vessel has substantially vertical side walls and a lower section disposed in the bottom of the vessel below the impeller and tapering inwardly to the first outlet.

3. An apparatus as claimed in claim 2 wherein the impeller includes a substantially vertical drive shaft disposed centrally in the vessel and at least one mixing element supported by the drive shaft.

4. An apparatus as claimed in claim 3 including an externally mounted motor and gear box assembly driving the drive shaft.

5. An apparatus as claimed in claim 4 including a stuffing box assembly to prevent ingress of slurry into the gear box assembly.

6. An apparatus as claimed in claim 3 wherein the impeller includes two mixing elements supported by the drive shaft and each comprising a series of mixing blades.

7. An apparatus as claimed in claim 3 including a scraper connected to the drive shaft and adapted to remove cement slurry from an inside surface of the vessel.

8. An apparatus as claimed in claim 7 wherein the scraper is positioned to scrape the inside surface near the top of the intended slurry volume.

9. An apparatus as claimed in claim 1 wherein the vessel is suspended from load cells to isolate vibration.

10. An apparatus as claimed in claim 1 wherein the vessel further comprises second and third inlets respectively adapted to introduce water and cement into the pressure vessel.

11. An apparatus as claimed in claim 10 including a control valve associated with each of the second and third inlets.

12. An apparatus as claimed in claim 1 wherein the vessel comprises a second outlet adapted to vent air displaced from the pressure vessel to atmosphere when the vessel is filled with water and cement.

13. An apparatus as claimed in claim 12 including a filter associated with the second outlet.

14. An apparatus as claimed in claim 12 including a control valve associated with each of the first and second outlets for selectively opening and closing the outlets.

15. An apparatus as claimed in claim 1 including a trailer adapted to support the pressure vessel for road transportation.

16. An apparatus as claimed in claim 15 including two pressure vessels mounted on the trailer.

17. An apparatus as claimed in claim 15 including a diesel generator and an air compressor for the vessel mounted on the trailer.

18. An apparatus as claimed in claim 1 including a valve for opening and closing the first outlet and a controller which controls the valve to open the first outlet when the vessel is pressurized by the driving fluid to above atmospheric pressure.

19. An apparatus as claimed in claim 18 wherein the controller controls the valve to open the first outlet when the vessel is pressurized by the driving fluid to between two and five bar.

20. An apparatus as claimed in claim 18 including a valve for opening and closing the first inlet, wherein the controller controls the valve for the first inlet to open the first inlet to admit the driving fluid while the agitating mechanism is mixing slurry within the vessel.

21. An apparatus as claimed in claim 18 wherein the controller controls the vibrating mechanism to vibrate the vessel while the agitating mechanism is mixing slurry within the vessel.

22. An apparatus as claimed in claim 1 wherein the vibrating mechanism vibrates the entire vessel.

23. An apparatus as claimed in claim 22 wherein the vibrating mechanism contacts a side wall of the pressure vessel.

* * * * *